US006568976B2

(12) United States Patent
Anderson et al.

(10) Patent No.: US 6,568,976 B2
(45) Date of Patent: May 27, 2003

(54) WATER FLOATATION CUSHION WITH DEPLOYABLE TETHER

(76) Inventors: Don Anderson, 18010 Balferm Ave., Bellflower, CA (US) 90706; Jim Way, 6542 Anthony Ave., Garden Grove, CA (US) 92845

( * ) Notice: Subject to any disclaimer, the term of this patent is extended or adjusted under 35 U.S.C. 154(b) by 0 days.

(21) Appl. No.: 09/770,414

(22) Filed: Jan. 29, 2001

(65) Prior Publication Data

US 2002/0102891 A1 Aug. 1, 2002

(51) Int. Cl.[7] ..... B63C 9/00
(52) U.S. Cl. ..... 441/80
(58) Field of Search ..... 441/80, 81, 84, 441/88, 89

(56) References Cited

U.S. PATENT DOCUMENTS

| | | | | | |
|---|---|---|---|---|---|
| 1,448,527 | A | | 3/1923 | Edmonds | |
| 3,676,882 | A | * | 7/1972 | Lindqvist | 441/85 |
| 4,017,927 | A | * | 4/1977 | Massey | 441/81 |
| 4,059,859 | A | * | 11/1977 | Hull | 441/81 |
| 4,195,380 | A | * | 4/1980 | Higgs | 441/10 |
| 4,459,714 | A | * | 7/1984 | Lin | 5/710 |
| 4,523,913 | A | * | 6/1985 | Kaino | 441/81 |
| 4,661,077 | A | * | 4/1987 | Griffith et al. | 441/84 |
| 4,713,033 | A | * | 12/1987 | Cameron | 441/84 |
| 4,822,309 | A | * | 4/1989 | Vandenberg | 441/35 |
| 4,976,642 | A | * | 12/1990 | Wilkie | 441/81 |
| 5,374,192 | A | * | 12/1994 | Marble et al. | 441/88 |
| 5,738,557 | A | | 4/1998 | Biesecker | 441/92 |
| 5,820,431 | A | | 10/1998 | Biesecker | 441/94 |
| 5,839,932 | A | | 11/1998 | Pierce et al. | 441/80 |
| 5,855,497 | A | * | 1/1999 | French | 441/84 |
| 6,004,177 | A | | 12/1999 | Biesecker et al. | 441/92 |
| 6,019,651 | A | * | 2/2000 | Driscoll et al. | 441/81 |
| 6,257,942 | B1 | * | 7/2001 | Groover | 441/84 |

* cited by examiner

*Primary Examiner*—S. Joseph Morano
*Assistant Examiner*—Lars A. Olson
(74) *Attorney, Agent, or Firm*—Dennis W. Beech

(57) ABSTRACT

The flotation cushion with deployable tether is generally the contour shape of a cushion without tether. A pocket is formed in the flotation cushion to conform to existing cushion structures. The tether is stored in the pocket in a manner to minimize bulging. With the tether attached at one end to the flotation cushion interior to the pocket, the flotation cushion may be thrown to a person in need of rescue while the user is grasping the tether at its free end. When the person to be rescued grabs the flotation cushion the tether may be used to retrieve the person and cushion.

8 Claims, 2 Drawing Sheets

WATER FLOATATION CUSHION WITH DEPLOYABLE TETHER

BACKGROUND OF THE INVENTION

1. Field of the Invention

This invention relates to aquatic rescue devices used by individuals for buoyancy in water. The new device incorporates a deployable tether with a flotation cushion.

2. Description of the Related Art

There are many known types of aquatic flotation devices for use by individuals. Examples include life vests, which may be inflatable, flotation rings commonly associated with boating and flotation cushions, which may also be used as seat cushions in a boat or other craft. Flotation cushions may or may not have holding straps or handles for use by an individual in holding or through which arms may be inserted to aid in retaining the cushion while being used in the water. Flotation rings may have a coiled rope or tether that is stored with the ring. This tether is retained at one end by the person throwing the flotation ring to a person in the water for use in rescue. The tether allows the individual in the water to be pulled to a boat or other location.

The present invention incorporates a tether and means for storage therewith in combination with a flotation cushion. The tether and attachment mechanism are storable in a pocket formed as part of the flotation cushion cover or structure. When the flotation cushion is thrown to a person in need of rescue in an aquatic environment, the rescuer can hold the free end of the tether for use in retrieving the cushion and a person grasping the cushion.

SUMMARY OF THE INVENTION

One object of the present invention is ease of retrieval of a deployed flotation cushion. Another object is simple storage of a tether with a flotation cushion.

In accordance with the description presented herein, other objectives of this invention will become apparent when the description and drawings are reviewed.

DESCRIPTION OF THE PREFERRED EMBODIMENT

Floatation cushions are generally rectangular in shape although other shapes may be used as for example circular. Variations in shape are usually used to fit the structure of the element into which the device will be incorporated or stored as a cushion. Flotation cushions usually have a flotation element contained in a cover which cover may also incorporate straps for use as handles to hold the cushion.

Figure 1:
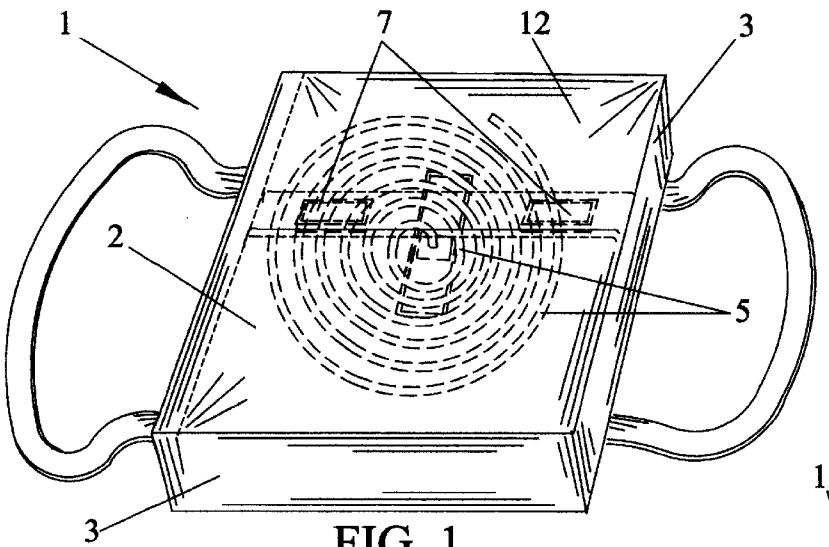
FIG. 1 illustrates a top perspective view of a flotation cushion with pocket and tether.
Figure 2:
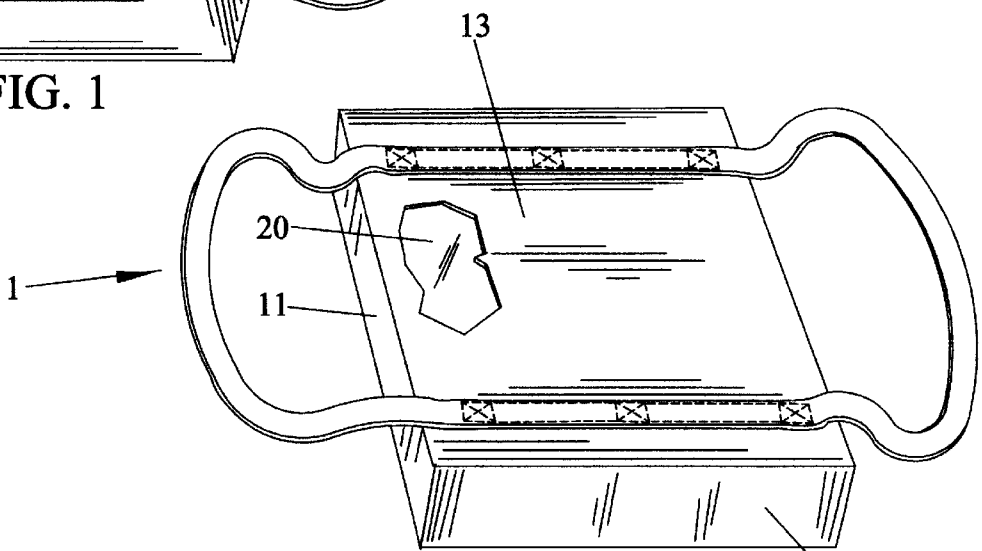
FIG. 2 illustrates a bottom perspective view.
Figure 3:
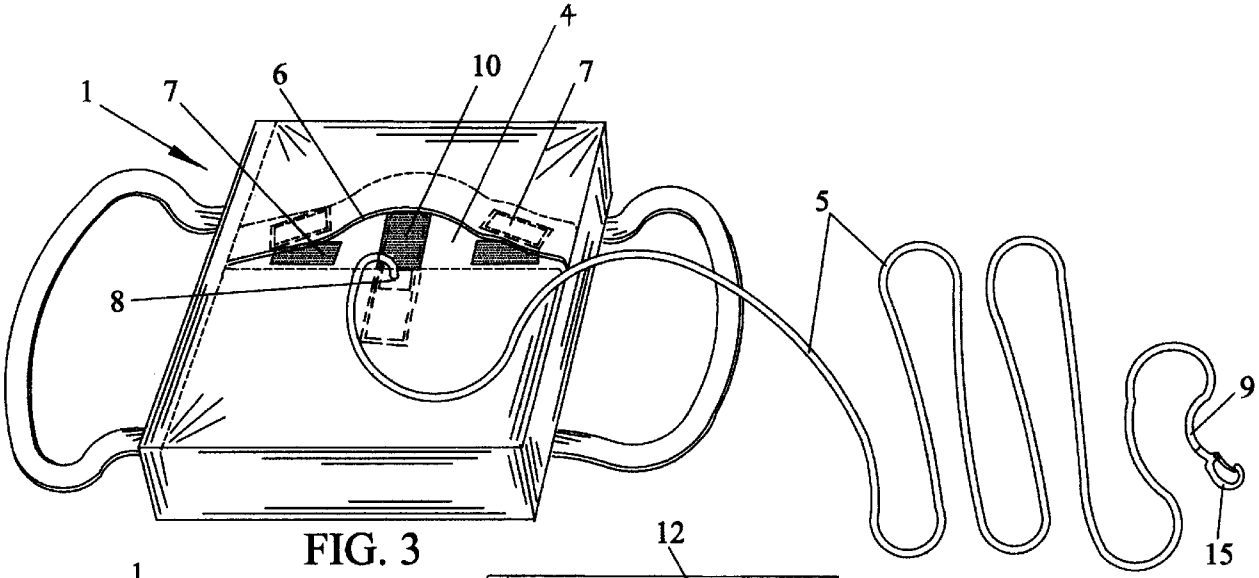
FIG. 3 illustrates a top perspective view with pocket opened and tether deployed.

Referring to FIG. 1 through 3, a flotation cushion (1) has a pocket (2) formed in the cover (3). The pocket (2) may have an internal element (4). The pocket (2) is formed to conform as closely as possible to the contour of the flotation cushion (1) when a tether (5) is stored therein.

The pocket (2) has opening (6) with closure elements (7), such as, hook and loop, snaps, zippers and the like. The pocket (2) may also be constructed with material overlay of the opening such that the closure elements (7) are not required. The tether (5) is illustrated as a coiled line or rope stored in the pocket (2) in a manner to minimize the bulging of the pocket (2). This method allows the cushion (1) with stored tether (5) to generally retain the original contour or shape.

The tether (5) is attached at one end (8) to the flotation cushion (1) and has free end (9). The attached end (8) may be retained by fixing the end in a patch (10), which is then sewn to internal element (4). The pocket (2) may have no internal element (4) and the tether (5) may be attached directly to the flotation element (20).

When it is desired to use the flotation cushion (1) for rescue the pocket (2) is opened and the free end (9) of the tether is grasped by the user. The flotation cushion (1) is then thrown to the person to be rescued and the tether (5) used to retrieve that person. The free end (9) may also have a fastener (15) attached, which may be used to engage the tether with an element of the boat or other structure from which the flotation cushion is being deployed.

Figure 4:
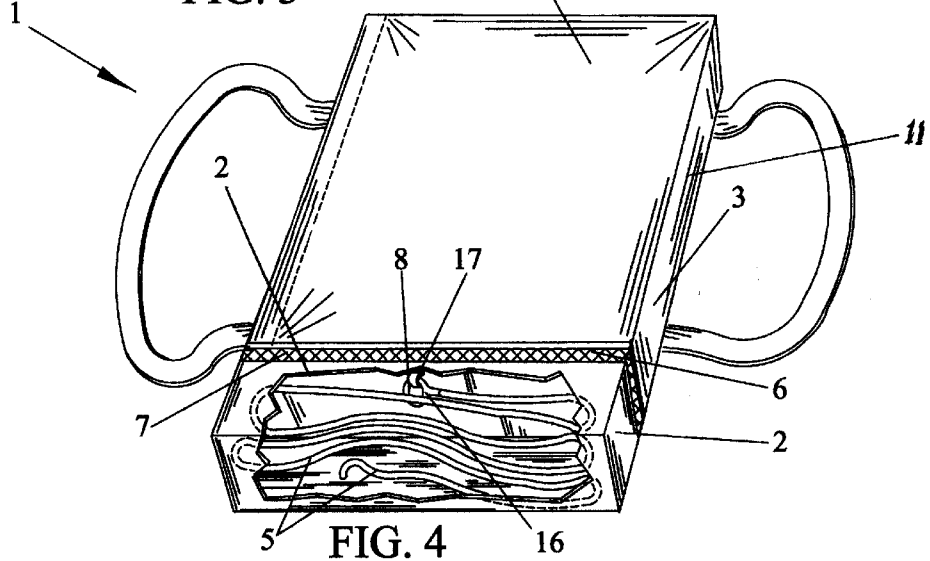
FIG. 4 illustrates an alternate top perspective view of the flotation cushion.

Referring to FIG. 4, an alternate location for the pocket (2) in the flotation cushion (1) is illustrated. In this instance the pocket is formed in an edge (11) rather than in the top (12) or bottom (13). The pocket (2) has an opening (6) with a closure element (7). In this embodiment a strip of hook and loop material may be used to close the opening (6). The tether (5) has a connecting ring (16) at the attached end (8) which may be retained by a loop (17), hook or the like attached to the flotation cushion (1) structure. Again the tether (5) is folded to minimize the size of the pocket (2) and any bulging thereof.

While the invention has been particularly shown and described with respect to the illustrated and preferred embodiments thereof, it will be understood by those skilled in the art that the foregoing and other changes in form and details may be made therein without departing from the spirit and scope of the invention.

We claim:

1. A device for use in rescue of persons in an aquatic environment comprising:

a throwable flotation cushion for use with boats and having a contour conforming pocket formed therein;

said contour conforming pocket having an opening therein and a closure element;

a tether attached at an end to said throwable flotation cushion interior to said contour conforming pocket;

said contour conforming pocket is structured for storage of said tether to minimize bulging; and said throwable flotation cushion useable as a seat cushion.

2. The device as in claim 1 wherein there is a fastener attached to said tether at a free end.

3. The device as in claim 1 wherein said contour conforming pocket is formed in a top of said throwable flotation cushion.

4. The device as in claim 1 wherein said contour conforming pocket is formed in a bottom of said throwable flotation cushion.

5. The device as in claim 1 wherein said contour conforming pocket is formed in an edge of said throwable flotation cushion.

6. The device as in claim 1 wherein said tether attachment is fixed to a patch.

7. A device for use in rescue of persons in an aquatic environment comprising:

a throwable flotation seat cushion for use with boats and having a contour conforming pocket formed therein;

said contour conforming pocket having an opening therein and a closure element;

a tether attached at an end to a patch attached to said throwable flotation cushion interior to said contour conforming pocket; and said contour conforming pocket is structured for storage of said tether to minim bulging of a cover.

8. A device for use in rescue of persons in an aquatic environment comprising:

a throwable flotation seat cushion for use with boats and having a contour conforming pocket formed in one of a top, a bottom and an edge thereof;

said contour conforming pocket having an opening therein and a closure element;

a tether attached at an end to a patch attached to said throwable flotation cushion interior to said contour conforming pocket; and said contour conforming pocket is structured for storage of said tether to minimize bulging of a cover.

* * * * *